US012410795B2

(12) United States Patent
Wagner et al.

(10) Patent No.: US 12,410,795 B2
(45) **Date of Patent: *Sep. 9, 2025**

(54) MEASURED VALUE STANDARDIZATION

(71) Applicant: KAESER KOMPRESSOREN SE, Coburg (DE)

(72) Inventors: Florian Wagner, Coburg (DE); Andreas Birkenfeld, Karlstadt (DE); Anika Hartwich, Coburg (DE)

(73) Assignee: KAESER KOMPRESSOREN SE, Coburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/558,747

(22) Filed: Dec. 22, 2021

(65) Prior Publication Data

US 2022/0333599 A1 Oct. 20, 2022

Related U.S. Application Data

(63) Continuation of application No. 14/376,454, filed as application No. PCT/EP2014/058632 on Apr. 28, 2014, now Pat. No. 11,231,037.

(30) Foreign Application Priority Data

Mar. 22, 2013 (EP) ..... 13160716

(51) Int. Cl.
*F04C 28/28* (2006.01)
*F04B 41/06* (2006.01)
(Continued)

(52) U.S. Cl.
CPC ..... *F04C 28/28* (2013.01); *F04B 41/06* (2013.01); *F04B 49/065* (2013.01); *F04C 28/02* (2013.01);
(Continued)

(58) Field of Classification Search
None
See application file for complete search history.

(56) References Cited

U.S. PATENT DOCUMENTS 7,263,413 B1 8/2007 Hofmann
RE40,817 E 6/2009 Krivoshein et al.
(Continued)

FOREIGN PATENT DOCUMENTS

CA 2842914 A1 1/2013
CN 202789642 U 3/2013
(Continued)

OTHER PUBLICATIONS

International Search Report issued Jul. 29, 2014; International Application No. PCT/EP2014/058632.
(Continued)

*Primary Examiner* — Matthew G Marini
(74) *Attorney, Agent, or Firm* — CANTOR COLBURN LLP

(57) ABSTRACT

The invention relates to a method for controlling and/or monitoring a compressor system comprising several components, namely one or more compressors (11, 12, 13) and one or more peripheral devices (14 to 21), and also a control/monitoring unit (22), wherein the compressors (11, 12, 13) and peripheral devices (14 to 21) are arranged or connected in a certain configuration. The method distinguishes itself in that in a measured-value-capture step, measured values are captured within the compressor system or the components, in an allocation step, context information is allocated to the measured value or measured values in advance, simultaneously, or after the measured-value capture, in order to standardize the measured values, and (Continued)

in an evaluation step, the measured value or measured values standardized by the context information is used in a control, monitoring, diagnostics, or evaluation routine.

18 Claims, 8 Drawing Sheets

(51) Int. Cl.

| | |
|---|---|
| ***F04B 49/06*** | (2006.01) |
| ***F04C 18/16*** | (2006.01) |
| ***F04C 28/02*** | (2006.01) |
| ***F04D 27/00*** | (2006.01) |

(52) U.S. Cl.
CPC ..... *F04D 27/001* (2013.01); *F04C 18/16* (2013.01); *F04C 2270/80* (2013.01)

(56) References Cited

U.S. PATENT DOCUMENTS

| | | | | |
|---|---|---|---|---|
| 2003/0099724 | A1 | 5/2003 | Mays | |
| 2003/0120619 | A1 | 6/2003 | Osborn | |
| 2004/0139070 | A1 | 7/2004 | Dysart | |
| 2006/0136100 | A1 | 6/2006 | Drouart | |
| 2008/0125887 | A1 | 5/2008 | Case | |
| 2008/0131258 | A1 | 6/2008 | Liepold | |
| 2010/0082293 | A1 | 4/2010 | Mitchell | |
| 2010/0152918 | A1 | 6/2010 | Riverin | |
| 2010/0214069 | A1 | 8/2010 | Kong | |
| 2012/0029706 | A1 | 2/2012 | Wagner | |
| 2013/0031483 | A1 | 1/2013 | Vure | |
| 2018/0084073 | A1* | 3/2018 | Walsh | G16Y 40/35 |

FOREIGN PATENT DOCUMENTS

| | | | |
|---|---|---|---|
| DE | 19826169 | A1 | 12/1999 |
| DE | 102008064491 | A1 | 6/2010 |
| DE | 102011079732 | A1 | 1/2013 |
| EP | 1213633 | A1 | 6/2002 |
| JP | 2006244072 | A | 9/2006 |
| JP | 2008181211 | A | 8/2008 |
| WO | 2007030421 | A2 | 3/2007 |
| WO | 2009108328 | A1 | 9/2009 |
| WO | 2012110733 | A1 | 8/2012 |
| WO | 2013013974 | A2 | 1/2013 |

OTHER PUBLICATIONS

Jakob Stoustrup, "Plug & Play Control: Control Technology Towards New Challenges" Proceedings of the European Control Conference 2009, Budapest Hungary, Aug. 23-26, 2009.

Oluwatope Ebenezer, "Plant-Wide Diagnosis: Causeand-Effect Analysis Using Process Connectivity and Directionality Information", Thesis, Jan. 20, 2012.

Snapshot of "document properties" showing publication date of Exhibit III; Created Jan. 19, 2012.

Snapshot of "document properties" showing publication date of Exhibit VB, Created Aug. 19, 2010.

Ulrich Eple, PandIX model description (B), Version 5.01, Aug. 19, 2010.

Ulrich Eple, PandIX model description, Version 5.01, Aug. 19, 2010.

* cited by examiner (Variant A)

(Variant B)

Stationary, oil-injected screw-type compressor

MEASURED VALUE STANDARDIZATION

CROSS REFERENCE TO RELATED APPLICATIONS

This application is a continuation of U.S. patent application Ser. No. 14/376,454 filed on Aug. 4, 2014, which was the U.S. National Stage of International Patent Application Number PCT/EP2014/058632 filed on Apr. 28, 2014 claiming priority to European Patent Application Number 13160716 filed on Mar. 22, 2013, the contents of all of which said applications is incorporated by reference herein.

TECHNICAL FIELD

The disclosure relates to a method for controlling and/or monitoring a compressor system comprising several components, namely one or more compressors and one or more peripheral devices, as well as a control/monitoring unit, wherein the compressors and peripheral devices are arranged or connected in a certain configuration.

BACKGROUND

Compressor systems represent a system made from a plurality of compressors and peripheral devices of various types which are coupled with each other by a network of air pipes and, with the use of heat recovery systems, by a network of water pipes. In general, compressor systems are designed individually for the conditions at the specific site. There is no generally valid structure for compressor systems. Therefore, the behavior of a specific compressor system can be analyzed and evaluated only to a limited extent without knowledge about the compressor system structure.

In the field of compressed air technology, it is possible to equip compressor systems with a control/monitoring unit. The task of the control/monitoring unit can be, for example, in combination or individually:

- to control the compressors and peripheral devices of the compressor system so that the required compressed air is generated and/or prepared with as little electrical energy as possible,
- to monitor the compressors and peripheral devices of the compressor system and, if necessary, to react to errors, such that, for example, defective compressors or compressors that have failed and/or peripheral devices are no longer used for generating and/or preparing compressed air, but instead different compressors and/or peripheral devices are used in their place and/or such that errors or failures of compressors and/or peripheral devices are reported as faults or warnings to persons or other technical systems, for example, by SMS, e-mail, network message, message window on a display, etc.

The object of the control/monitoring unit can also be to collect measured values occurring in the compressor system and to store them as time curves or provided with a timestamp, in order to evaluate these measured values at a later time in the control/monitoring unit or also in other technical systems. It can be of particular interest to collect a large quantity of different measured values from inside or also from outside the compressor system, in order to create analyses from these values and to be able to make judgments at a later time, especially by forming correlations, etc.

One problem in conventional systems, however, is that often a plurality of measured values can be generated or has already been captured, but these measured values have not been standardized to a sufficient extent for valid judgments to be made. In particular, these measured values are not accessible to automatic evaluation/processing.

The standardization of measured values in a compressor system is often subject to the following, in no way conclusive, list of challenges:

Every compressor system has an individual configuration, that is, an individual configuration of the compressors and peripheral devices.

In addition, the sensors installed in the compressor system are also arranged individually (both with respect to quantity and also with respect to connection) and are thus in no way standardized.

Compressors and peripheral devices of a compressor system typically originate from different manufacturers and therefore provide manufacturer-specific (or even control hardware-specific) formats for the captured measured values. Even compressors or peripheral devices of the same type sometimes provide different measured values, because, for example,

- the compressors or peripheral devices of the same type are connected to the control/monitoring unit by different technologies (e.g., discrete wiring vs. use of a bus system) and therefore differ in the quantity of the available measured values, or
- the compressors or peripheral devices of the same type are equipped with different sensors and therefore differ in the combination of the provided measured values, or
- there is a mixture of the two conditions mentioned above.

The disclosure therefore aims to provide, for a method for controlling and/or monitoring a compressor system, a method according to which measured values can be standardized.

A core idea of the present disclosure comes from the following main concept: to be able to further process the captured measured values that are relevant for the compressor system in different problems, it is essential that the meaning of the measured values is defined and known at the latest at the time of the evaluation of the measured values. It can also be advantageous if the measured values are prepared with a defined and known meaning in advance, during, or as a result of the method, so that they can be further processed in the control/monitoring unit, but also in other technical systems.

The preparation can be regarded as measured-value standardization. The measured-value standardization also has the advantage that measured values from various compressor systems can be processed without compressor system-specific adaptations of the routines provided for processing the measured values.

According to one specific aspect of the present disclosure, the measured-value standardization is realized, such that context information is allocated to the measured value itself, so that the context of the measured value is defined at the latest at the time of the evaluation of the measured value.

The context of the measured value can indirectly or directly define the location of the measured-value capture and/or the medium (e.g., oil, compressed air, ambient air, cooling water, etc.) that the measured value refers to.

In exceptional cases, indirect context information can also be realized by defining a name if this is sufficiently clear. This can be explained with the following example: if, for example, the manufacturer KAESER has determined that PN will always designate the machine output pressure, then this convention indirectly defines the location of the measured-value capture, thus defining the context for the measured value, pressure. However, it must be considered that the definition of a name is only a very weak determination of the meaning of a measured value, because it is very likely that the definition of a name will be used or interpreted differently by different persons, so that unique context for the measured value cannot be absolutely guaranteed by the definition of a name. In addition, a measured value can have several not absolutely contradictory meanings that can change specifically to the compressor system or component. Preferred context information defines the location of the measured-value capture directly, for example, by using a model of the components or the compressor system.

Control, monitoring, diagnostics, or evaluation routines should be understood very generally to include different control tasks, monitoring tasks, diagnostics tasks, or evaluation tasks.

When it is mentioned that the compressors and peripheral devices are arranged or connected in a predetermined configuration, this should be understood in the sense that this also includes several changing states, for example alternative configurations that can be achieved by switching a valve or a switch. A predetermined configuration is, in this respect, the set of all conceivable configurations that the compressor system can assume in different operating states.

A configuration can be defined, for example, in the form of a P&I (Piping & Instrumentation) schematic and can capture, in this respect, the interactions of the compressors and peripheral devices or the elements of a component from various aspects or in different domains, wherein, for the implementation of the disclosure, the capturing of the interactions in one domain and from one aspect is obviously sufficient. Possible domains or possible aspects can be, but are not limited to, compressed-air interactions that can be reproduced in a P&I schematic in a strict sense, in particular, in a compressed-air P&I schematic, interactions related to heat recovery that can be reproduced in a P&I schematic in a strict sense, in particular, in a heat recovery P&I schematic, interactions related to cooling water circuits that can be reproduced in a P&I schematic in a strict sense, in particular in a cooling water circuit P&I schematic, and interactions related to power supply that can be reproduced in an electrical circuit diagram.

A P&I schematic in the sense of the present disclosure can also be abstracted in a restricting way to the basic interactions from one aspect/one domain and in this respect do not have to include all of the details of an otherwise possibly typical P&I schematic. Instead of the term P&I schematic, in this respect, a graphical representation of the interactions in a certain aspect/certain domain could also be understood, as for example a graphical representation of the compressed air interactions, a graphical representation of the heat recovery interactions. In this respect it involves a flow chart that reproduces the flow of energy and/or operating means and/or compressed air between the individual compressors and the individual peripheral devices or between the individual elements of a component.

The P&I schematic or part information of an P&I schematic, namely

- which components or elements are involved,
- which links or connections exist between at least one part of the components or at least one part of the elements, as well as
- where predefined measurement locations are, can be provided, for example, by a file from the manufacturer of the components or the elements and/or from the system builder and/or from the system operator.

In one possible embodiment, the measured-value-capture step can comprise the direct capture of a measured value by measurement and/or the use of already existing, in particular, stored measured values. The already existing, stored measured values can be, on one hand, measured values from the directly represented compressor system or external measured values. External measured values can be comparison data from other compressor systems or ambient data, for example air humidity, air temperature of the external or ambient air.

In a similarly preferred embodiment, the measured-value-capture step comprises, in addition to the direct capture of the measured values by measurement, also the storage of these measured values in an allocated database that can be implemented in one or more components in the compressor system or externally.

In another preferred embodiment, the standardization of the measured value by means of allocation of context information specifically comprises the unique allocation of the location of a measured-value capture and/or the medium that the measured value refers to (e.g., oil, compressed air, ambient air, cooling water, etc.) to a measured value within an allocation step according to the disclosure. In the context of the present application, the location of the measured-value capture is always understood to be the real location where a measured value is captured, while the designation measurement location always designates the localization of this real location within a basis model. When the allocation of the location of a measured-value capture is discussed, this can be understood in that specifically one location, but also two or more locations, can be allocated to the measured value. Similarly, allocation of the medium that the measured value refers to is to be understood such that a single medium and also two or more media can be allocated as context information to one measured value.

In one particular concrete embodiment, the location of the measured-value capture is defined by one or more basis models of the specific compressor system or comparable compressor systems and/or one or more basis models of the specific components or comparable components.

These basis models can be defined, for example, by the previously mentioned P&I schematics of the compressor system or the previously mentioned P&I schematics of the corresponding components.

In another preferred embodiment of the method according to the disclosure, it is provided that at the latest directly before or for the utilization step

- the measured value itself,
- the allocation of the measured value to context information or a measurement location, and
- the basis model with reference to which the context information or the measurement location are defined, are known and taken into account in this respect in the subsequent control, monitoring, diagnostics, or evaluation routine.

In this respect it is necessary, for a valid interpretation of standardized measured values, to know not only the measured value itself and the allocation of the measured value to context information or a measurement location, but also the reference basis model in which the measurement location or, with reference to which, the context information is defined. In specific embodiments, for example, all three components (measured value, allocation, and model) could be stored in a control/monitoring unit, wherein at the same time the evaluation or the subsequent utilization step also takes place in this control/monitoring unit. Alternatively, the three components (measured value, allocation, model) could be read from the control/monitoring unit, in order to evaluate the standardized measured values in external systems that do not have to be under control of the control/monitoring unit, with routines for monitoring (diagnostics, predictive maintenance, etc.).

Here, several preferred alternatives for defining the location of the measured-value capture are conceivable. In a first conceivable variant, a pre-configured measurement location on a component or on an element of a component is allocated to the measured value, wherein linking of the component to other components or linking of the element to other elements is not taken into account. In a second variant, compared with the definition according to the first variant, it is also provided that the measurement location on a component or on an element of a component is freely configurable, wherein linking of the component to other components or linking of the element to other elements is also not taken into account. In a third variant, the connection of the components by a basis model of the compressor system or the connection of the elements by a basis model of the components is known. In this third variant, a pre-configured measurement location in this basis model is allocated to the measured value. Finally, in a fourth variant, a freely configurable measurement location in the basis model that takes into account the interconnected components or the interconnected elements can be allocated to the measured value. The allocation of context information to a measured value can be preferably realized by an allocation table.

The allocation by an allocation table can be generally understood in that the list or set of allocations does not have to exist exactly in tabular form, for example in an Excel table, but could also be represented in formats such as XML or JSON.

By indicating the measurement location that a measured value refers to in the form of allocated context information, and therefore so that the model forming the basis of the context information is known, the measured value standardized in this way can be correctly evaluated or analyzed in later evaluation routines or analysis steps and used as a basis in other routines.

Components of the basis model of a compressor system are here a) at least one component, b) optional links or connections between at least one part of the components (there can also be components without connections), as well as c) optional measurement locations.

With respect to defining the model it should be noted that each of a), b) or c) could be predefined/predetermined, but could also be defined completely or partially before, during, or after the commissioning of the compressor system. Purely as an example, EP 13159618 is referenced. In that document it is proposed, among other things, to define a model of the compressor system such that the user/system builder inputs the given P&I schematic into the control/monitoring unit via an editor during the commissioning.

With respect to the basis model of a component, the following should be noted: the components of the basis model of a component comprise a) at least one element, b) optional links or connections between at least one part of the elements (there could also be elements without connections), as well as c) optional measurement locations.

The basis model of a component can be predefined/predetermined, where a), b) or c) is concerned, but it could also be defined completely or partially during or after commissioning of the compressor system. An specific example could be designed as follows: the control/monitoring unit stores general component models (i.e., component models that fit many applications). The operator of the compressor system can adapt the component model by adding or removing Elements, Links/connections, Measurement locations, so that they are relevant to/can be used for the specific components in the compressor system.

Regardless of whether the allocation of context information is provided by an allocation table or in some other way, it must be defined that, for the specific definition of the allocation of the context information to a measured value, in particular, with reference to a basis model, different variants are conceivable. The following conceivable variants are mentioned but this list is in no way exhaustive:

The operator of a compressor system manually allocates the context information of measurement values. This could happen, e.g., during the commissioning.

The context information is provided by the system builder (or component manufacturer), for example by a file.

A component, that is a compressor or a peripheral device, transmits, in addition to the measured values, the context allocation (and if necessary also the basis model in which the context information is defined) to the control/monitoring unit.

The measured values captured in the measured-value-capture step can be physical or logical variables, for example values captured by sensors within the compressor system or within the components and/or values captured by sensors outside of the compressor system (e.g., public climate database, weather stations, ambient air thermometer, measured values provided by other compressor systems, or similar values and/or actuator positions and/or ready states of machines and/or operating states and/or control variables.

Although this is in no way required and with respect to data can even be disadvantageous, it is obviously possible to store the measured value itself and the allocated context information together as a data pair. It could be significantly more elegant, however, to combine the measured values and allocated context information for the first time in the evaluation or analysis step, etc., that is, when there is a specific requirement for utilization of the measured values.

In one possible embodiment it is conceivable that, as additional context information, even the overall state of the compressor system at the time of the data capture and/or individual components can be allocated to the measured value or values. In this way it is ensured that undifferentiated measured values of a compressor in start-up operation are not compared with measured values of a compressor in a stable operating state, without these different boundary conditions also being taken into account in such a comparison. The overall state of the compressor system can also be taken into account, for example, such that, as additional context information, one or more other measured values of the compressor system at this time can be allocated to the measured value or values, from which the state of the compressor system or a sub-state of the compressor system can be derived. If this additional measured value or these additional measured values are provided, for example, with a timestamp, then the allocation of this additional measured value or these additional measured values can also be realized at a later time, because then measured values with the same or comparable timestamp can be considered and allocated to the considered measured value.

While it was previously described that multiple units of context information could be allocated to one measured value in the scope of a (single) model, in another possible embodiment it is also conceivable that context could be allocated to one measured value simultaneously in several basis models. For example, it could be imagined that, for a stationary, oil-injected screw-type compressor, a basis model (component basis model) for the pure air circuit and a basis model (component basis model) for the pure oil circuit could exist simultaneously. For the standardization of the measured value of the compression end temperature (VET), the same measured value would then be allocated in both basis models to the context "Temperature on the pressure side of the compressor block."

In one specific, preferred embodiment, the measured value also comprises a timestamp. The linking with a timestamp or the continuous time capturing allows for judgments to be made on the development of individual measured value or the relevant components or even the entire compressor system.

In one preferred embodiment of the method according to the disclosure it can be further provided that, in a first-preparation step of the measured value, it is checked whether the measured value including variable type and (physical) unit is captured and, if not, the variable type and unit are allocated to the measured value in this first-preparation step, in particular on a stored basis model, manually or automatically by an allocation table.

Furthermore, it is viewed as a preferred embodiment of the method if, in particular from the control/monitoring unit, also a history of basis models and/or a history of context allocations is stored, in order to determine which basis models or which context allocations were valid at each given time. In this way it can be determined for each measured value captured with a certain timestamp what meaning or what context information must be given to a measured value on the basis of a combination of the basis model valid for this timestamp with the context allocations valid for this timestamp.

The disclosure further relates to a compressor system comprising several components, namely one or more compressors and one or more peripheral devices, as well as a control/monitoring unit, wherein the compressors and peripheral devices are arranged or connected in a predetermined configuration, wherein the control/monitoring unit has a measured-value-capture unit or interacts with a measured-value-capture unit, which is formed for capturing measured values within the compressor system or the components, wherein the control/monitoring unit further comprises an allocation unit or interacts with an allocation unit that is formed to allocate context information to the captured measured values, in order to standardize the measured values, and wherein the control/monitoring unit comprises an interface, in order to forward or use itself the measured values standardized by the context information in subsequent control, monitoring, diagnostics, or evaluation routines.

BRIEF DESCRIPTION OF THE DRAWINGS

The disclosure is explained in more detail below also with respect to additional features and advantages using the description of embodiments and with reference to the accompanying drawings. Shown here are.

DETAILED DESCRIPTION

Figure 1:
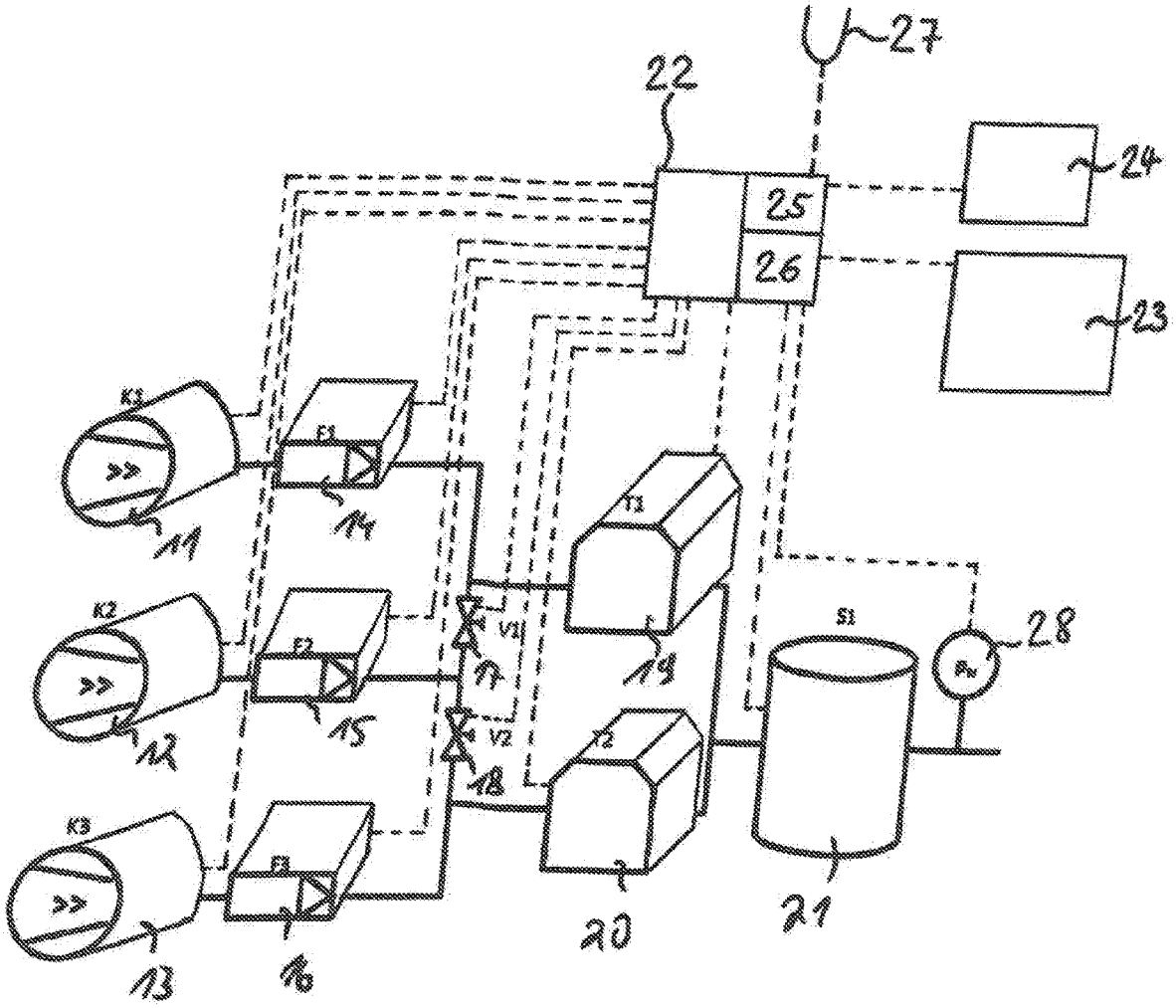
FIG. 1 an exemplary configuration of a compressor system that interacts with the control/monitoring unit according to the disclosure.

In FIG. 1, an example of a configuration of a compressor system is illustrated that interacts with a control/monitoring unit. The illustrated example of the compressor system comprises three compressors 11, 12, 13 arranged parallel to each other. To each compressor 11, 12, 13 a filter 14, 15, 16 is uniquely allocated, which is arranged downstream of the allocated compressor 11, 12, 13. Downstream of the filters 14, 15, 16, two dryers 19, 20 are connected. The compressed air downstream of the first filter should always flow through the first dryer 19. The compressed air downstream of the second filter can be guided by two valves 17, 18 either through the first dryer 19 or through the second dryer 20. The two valves 17, 18 are designed or controlled such that they are never opened simultaneously, that is, when the first valve 17 is open, the second valve 18 remains closed and when the second valve 18 is open, the first valve 17 remains closed.

Downstream of the two dryers 19, 20 there is a compressed air storage device 21. Downstream of the compressed air storage device 21 there is a pressure sensor 28 for capturing the operating pressure given there.

To control and/or monitor the compressor system, a control/monitoring unit 22 is provided, which is interactively connected to the compressors 11, 12, 13, as well as to the filters 14, 15, 16, the valves 17, 18, the dryers 19, 20, the compressed air storage device 21, and the pressure sensor 28. The filters 14, 15, 16, the valves 17, 18, the dryers 19, 20, the compressed air storage device 21, and the pressure sensor 28 here form peripheral devices of the compressor system. Together with the compressors 11, 12, 13, these peripheral devices form the components of the compressor system.

The control/monitoring unit 22 is also in active connection with a memory section 24 and an editor 23. The memory section 24 and/or editor 23 could also, however, be integral parts of the control/monitoring unit 22. The control/monitoring unit 22 can here fulfill control functions, monitoring functions, or control and monitoring functions.

Monitoring should be understood here to be any form of evaluation, that is, in addition to monitoring for error functions, unusual operating states, alarm situations, etc., also diagnostics, especially in the event of an already present error message, an analysis or evaluation, for example with respect to optimizing or evaluating for predictive maintenance.

The control/monitoring unit 22 comprises, in the present embodiment, a measured-value-capture unit 25 and also an allocation unit 26, that are here both parts of the control/monitoring unit 22. However, it is also possible to provide, in other embodiments, the measured-value-capture unit 25 completely or partially separate from the control/monitoring unit 22. In addition, it is also possible to provide the allocation unit 26 completely or at least partially separate from the control/monitoring unit 22.

In the present embodiment, the control/monitoring unit 22 records measured values within the compressor system or within the components during operation of the compressor system or during operation of the components, in the start-up and/or shut-down phases, or in rest states. The measured values can be various data, namely physical variables or variables derived from these or also logical variables, for example values captured by sensors within the compressor system or within the components and/or values captured by sensors outside of the compressor system (e.g., public climate database, ambient air thermometer, measured values of other compressor systems, measured values transmitted from compressed air consumers, etc.) and/or actuator positions and/or ready states of machines and/or operating states and/or control variables.

With the measured-value-capture unit 25, the control/monitoring unit 22 captures such measured values, whether through actual measurement within the compressor system or through transmission from the components to the control/monitoring unit, whether through targeted polling of individual components within the compressor system or through targeted polling of measured values, for example in databases external to the compressor system or databases allocated in the compressor system. The measured value is unusable as such for a subsequent control, monitoring, diagnostics, or evaluation routine, if its measured value meaning is not defined, that is, context information cannot be allocated to the measured value. For this reason, in the allocation unit 26, the context information is allocated to a measured value, in order to standardize this measured value.

Such an allocation in an allocation step can take place in advance, simultaneously, or after the measured-value capture. By marking the measured value with context information, this data pair can be taken into account as a standardized measured value in the subsequent control, monitoring, diagnostics, or evaluation routines. The context information defines an allocation of the location of a measured-value capture and/or the medium that the measured value refers to.

In one specific preferred embodiment, for the allocation of the location of the measured-value capture and/or the medium that the measured value refers to, one or more basis models of the specific compressor system or comparable compressor systems are taken into account. The obtained measured value can be handled meaningfully only if the context in which the measured value was determined is known.

Figure 2:
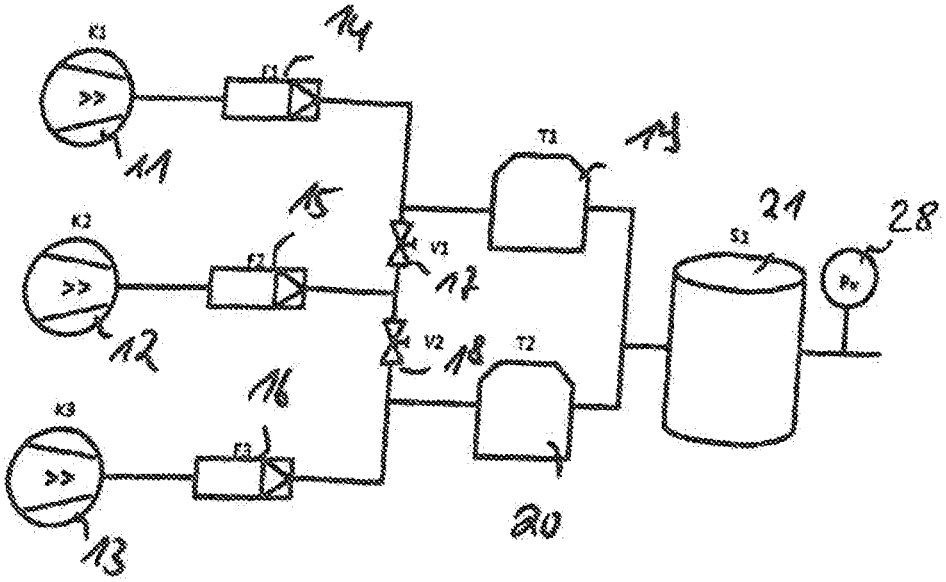
FIG. 2 a basis model that represents the compressor system in its specific given configuration in the form of a P&I schematic.

The compressor system according to FIG. 1 can be described, for example, in a P&I schematic according to FIG. 2. In this respect, the P&I schematic according to FIG. 2 forms a basis model for the compressor system according to FIG. 1, by defining the active relationships within the compressor system. If a measured-value capture is positioned within such a model, as the P&I schematic according to FIG. 2 defines, the context information of the measured value is clear and defines, in this respect, the meaning of the measured value.

Although a basis model in the form of a P&I schematics, as is reproduced in FIG. 2 for the compressor system according to FIG. 1, an especially suitable model is defined, in order to give the most precise context information possible for a measured value, weaker context information that codes the location of the measured-value capture is also conceivable and expedient. A first conceivable coding could take place by a name definition if this name definition is sufficiently clear.

This shall be explained below with reference to FIG. 3. For example, if the manufacturer KAESER has determined that PN shall always designate the machine discharge pressure, then the location of the measured-value capture is directly determined by this name definition, therefore the context is defined for the measured value pressure.

Figure 3:
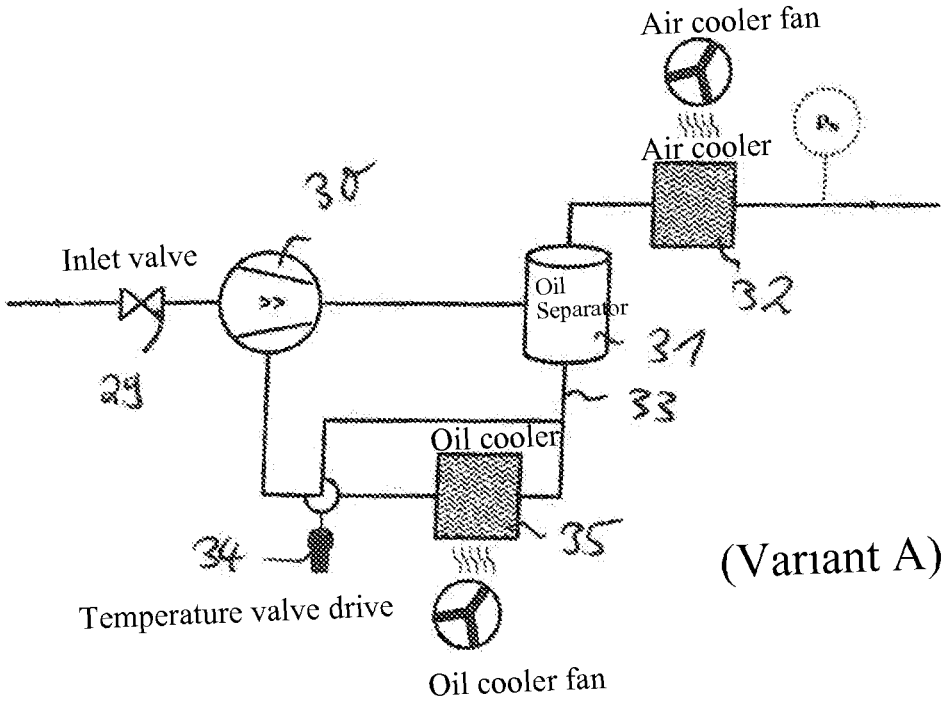
FIG. 3 a representation for illustrating an indirectly defined location of a measured-value capture by a name definition.
Figure 3:
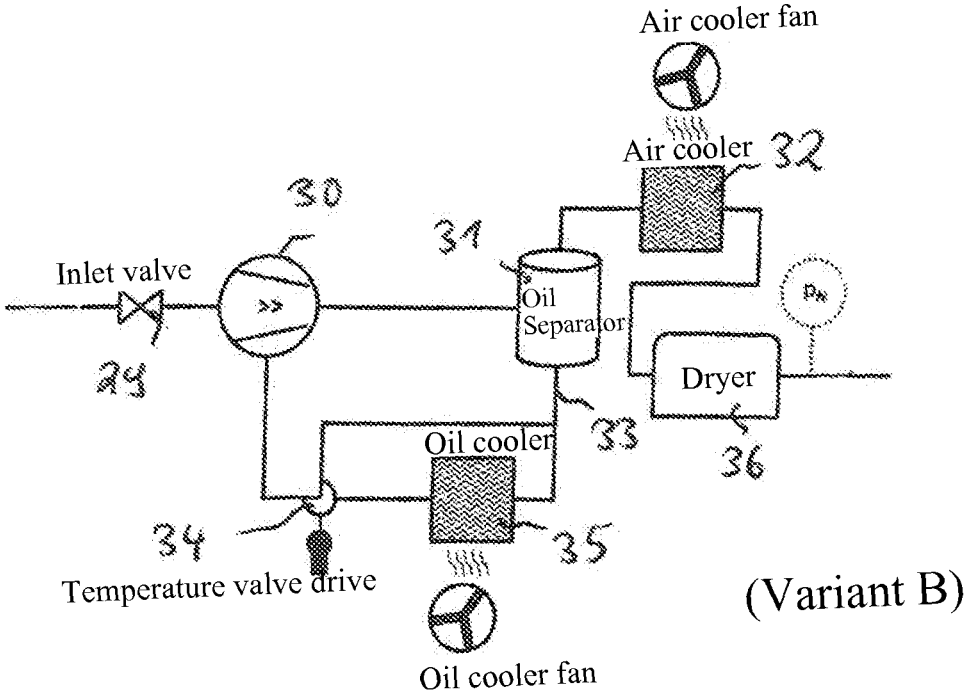

In FIG. 3, two variants for compressors are shown that comprise first an inlet valve 29, a compressor block 30 with a screw-type compressor, and downstream of the compressor block 30 an oil separator 31, which forwards the heated compressed air to an air cooler 32. An oil circuit 33 feeds oil for cooling the compressor block 30 and for guaranteeing a lubricant film on the screw in the compressor block, wherein the oil mixed with compressed air and generated under pressure is fed back in the already mentioned oil separator 31 and returned to the compressor block 30, wherein a partial flow adjustable by a temperature valve 34 can be guided via an oil cooler 35 for reducing the oil temperature. The two compressors shown in FIG. 3 with reference to a P&I schematic differ in that the compressor shown above is equipped without an internal add-on dryer 36 (variant A), the compressor shown below, however, is equipped with an internal add-on dryer 36 (variant B).

Indeed, by the name convention, it is now determined that PN designates the machine discharge pressure; but whether the compressed air was first guided through an add-on dryer 36 of the compressor (variant B) or not (Variant A) cannot be derived via this name convention.

In this respect, it is useful to also code the P&I schematic of the compressor—at least along general lines—in more precise context information of the measured value captured on the pressure sensor 28, so that, with reference to this model-based information, it is clear whether the pressure captured on the pressure sensor 28 measures compressed air that flows through an add-on dryer 36 (variant B) or is discharged by the compressor without add-on dryer 36 (variant A).

Figure 4:
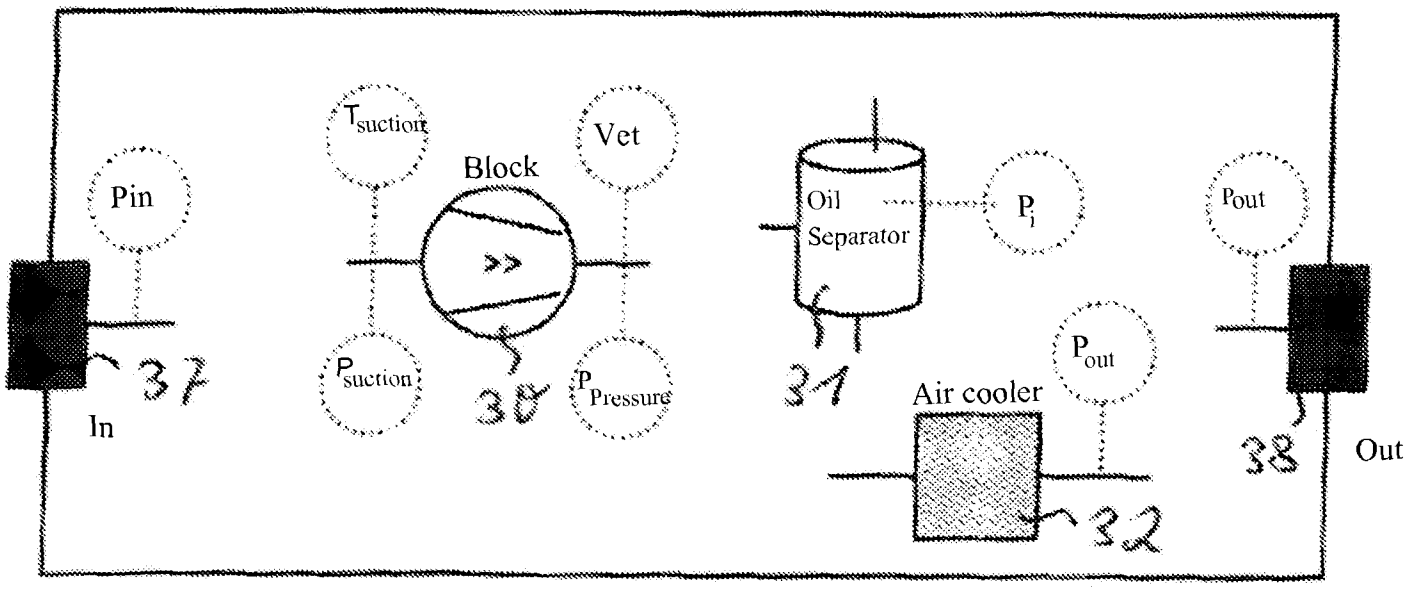
FIG. 4 a basis model for defining the context information for a stationary, oil-injected screw-type compressor according to a first variant.

In FIG. 4, a simplified model for defining the context information for a stationary, oil-injected screw-type compressor is shown, wherein here the interactions between the individual elements of the compressor block 30, oil separator 31, air cooler 32, input 37, output 38 are not defined. With respect to the element compressor block 30, the pressure and temperature can be captured both on the suction side and also on the pressure side (Tsuction, Psuction, VET, Ppressure), In contrast, for the oil separator 31, only the capture of a pressure (Pi), but not, e.g., the capture of a temperature, is provided for.

The standardization of the meaning of measured values takes place only in that one or more measurement locations in the model for standardizing the meaning of measured values is allocated to a measured value.

Figure 5:
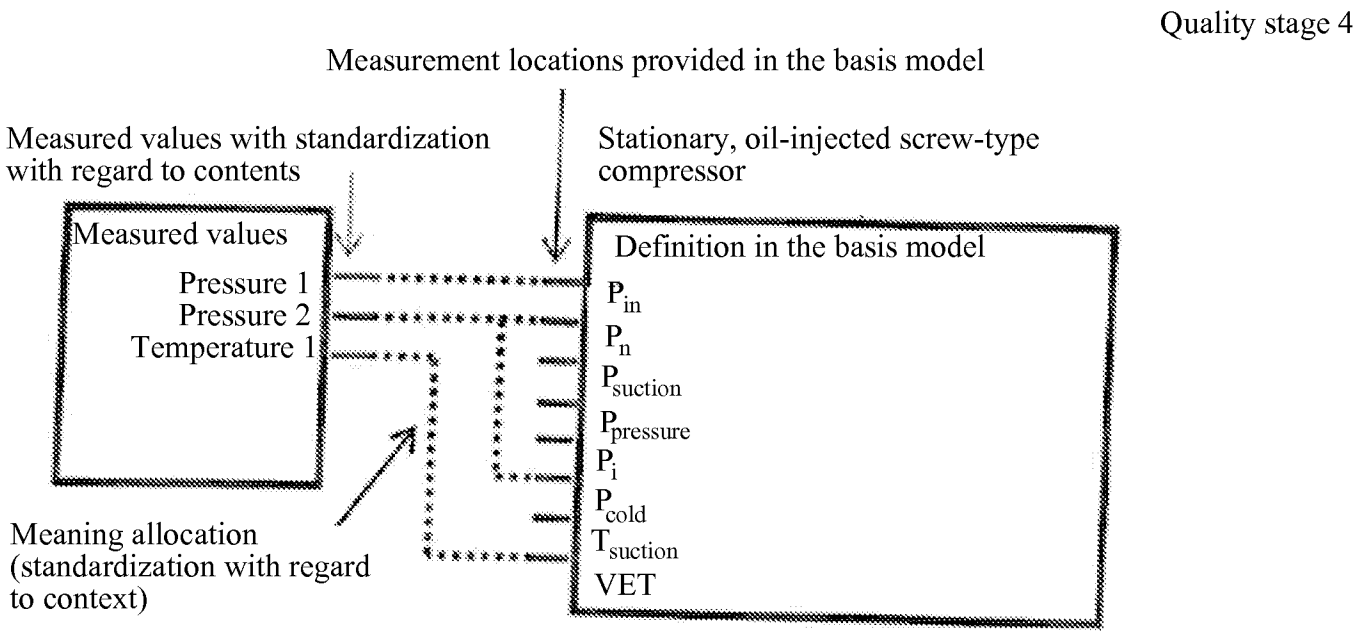
FIG. 5 an illustration of the allocation of measured values to configured measurement locations of a component, as shown with reference to FIG. 4.

The basic principle is shown with reference to FIG. 5. The measured values captured for a component are standardized—at the latest after a first measured value preparation— with respect to the content, so that the physical variable type (pressure, temperature, etc.) and the unit (Pa, K, etc.) are also known. Context information should now be allocated to the measured values, pressure 1, pressure 2, temperature 1, prepared in a first step. Here, the basis model of a component, in reality the stationary, oil-injected screw-type compressor according to FIG. 4 is used in which basically for these components, namely a stationary, oil-injected screw-type compressor without an add-on dryer, it is defined which measurement locations are basically predefined. These are each reproduced in FIG. 5 in the "context information" field. Now the measured value or measured values, specifically pressure 1, pressure 2, temperature 1 are allocated to a measurement location predefined in the basis model of the component according to FIG. 4, wherein this allocation is here specifically realized by a connecting line between each measured value and the context information. Through this allocation of the measured value to a provided measurement location in the basis model, the meaning of the measured value with respect to the context is now defined.

Here it must be noted that a measured value can also be allocated to two measurement locations (here illustrated using the example of "Pressure 2"). For a multiple allocation of one measured value to measurement locations, a sub-meaning for a measured value must be shown (here, specifically: "Pressure downstream of the air cooler" and "Machine output pressure"). This type of context information is necessary in many cases, because, in reality, one measurement location can also sit between two components (and thus have a relationship to both components). However, if a basis model according to FIG. 4 is used as the basis, then the interactions between the components are not modeled.

The method explained with reference to FIG. 4 for standardizing the meaning of measured values has the limitation that only measurement locations that were preconceived in the basis model according to FIG. 4 (variable type on certain connection of a component) can be used for the standardization of the meaning of measured values. To soften this limitation, the method can further provide that some measurement locations can be defined in basis models of components, in order to use these for the standardization of the meaning of measured values. For this definition of context information it should be further noted that the components are defined in advance and the linking of the components is not considered.

Figure 6:
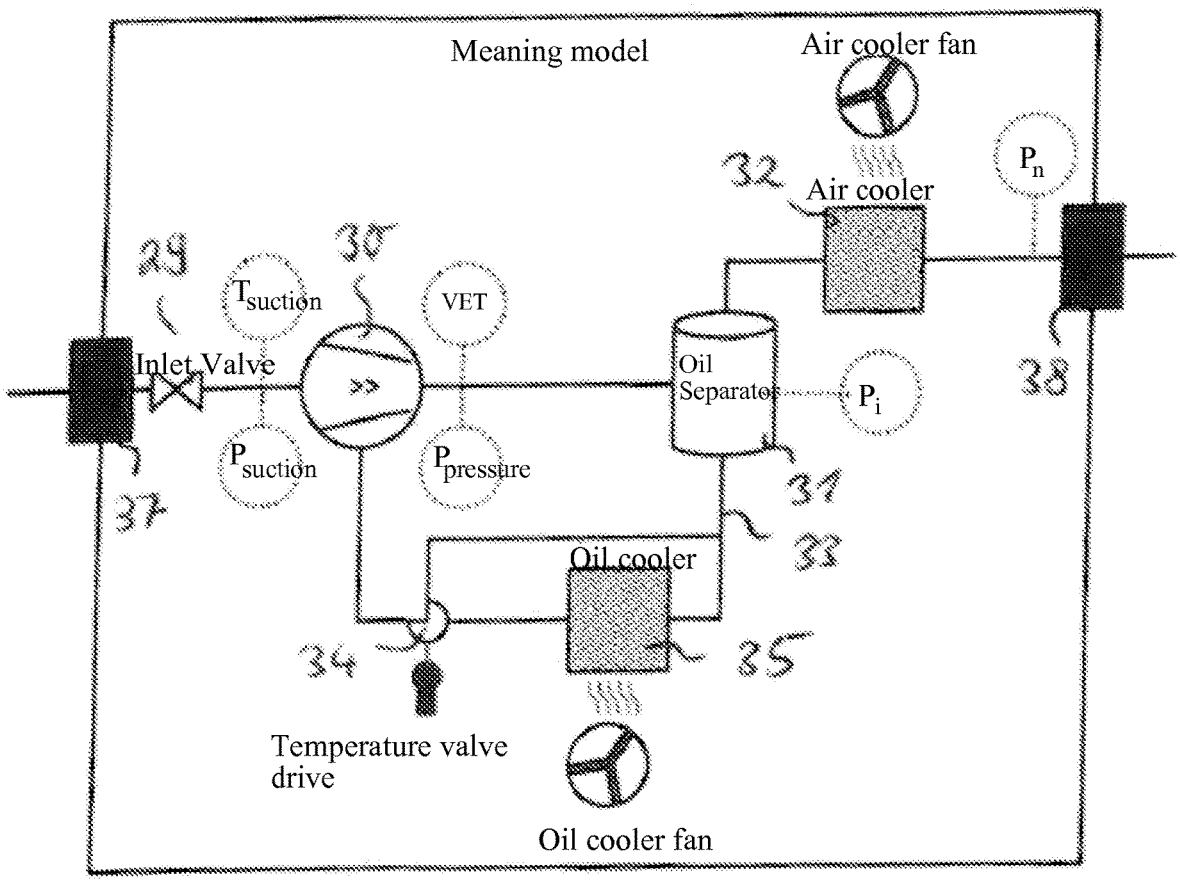
FIG. 6 a basis model for defining the context information for a stationary, oil-injected screw-type compressor according to a second variant.

In one improvement of the standardization of the measured values, a basis model for a component according to FIG. 6 will now be referenced, in which not only the individual elements of the component itself are defined, but also the linking between the individual elements is defined. As an specific example for a corresponding basis model, a stationary, oil-injected screw-type compressor without add-on dryer was referenced here.

The pre-defined measurement locations in the basis model are specified again. The measurement locations correspond to the measurement locations in FIG. 4. However, in the basis model that now also codes the interactions of the individual elements, the information already includes that $_{Pcold}=_{PN}$ and thus $_{Pcold}$ can be eliminated as a pre-configured measurement location. The allocation step for individual measured values can then be performed as described with reference to FIG. 5 in connection with the basis model according to FIG. 4.

In another stage of expanding the basis model according to FIG. 5, it is possible to freely configure the measurement locations for a variable type on certain connections of an element.

The definition of a measurement location and the allocation of captured measured values to a measurement location within a basis model were previously explained with reference to the example of a stationary, oil-injected screw-type compressor without add-on dryer. It is self-explanatory that this procedure can also be transferred to any other component of a compressor system or to the compressor system itself. If the basis model according to FIG. 4 for an individual component is transferred to the entire compressor system, then essential or all components of a compressor system are defined without their specific interactions. Pre-configured measurement locations at the individual components were predefined for different measurement variables. Context information could be allocated in the same way to each captured measured value. Obviously it is also possible to provide in one modification not only pre-configured measurement locations on the individual components of a compressor system, but also to allow that corresponding measurement locations can be freely configured.

In a modified embodiment, however, for a compressor system not only the essential or all components are defined, but also the interactions between the components are known, for example with reference to a P&I schematic, as illustrated with reference to an example of a compressor system according to FIG. 2. In this case, pre-configured measurement locations can also be defined in a corresponding basis model. In another modification, however, it is also possible that such measurement locations can be freely configured within the basis model. It is decisive that for each captured measured value, specific context information can be allocated with reference to such basis models.

There are basically many different uses for standardized data. Standardized measured data can be used, for example,

- to be able to specify a starting value for the first simulation step in simulation models,
- to compare real measured data with data derived via a model in a diagnostics routine,
- to conduct analyses about the reliability of individual components or the entire compressor system, for example from the aspect of energy consumption,
- a prediction for performing the next maintenance measures under the most accurate measured data possible from the past, etc.

As a whole, for the analysis not dependent on the individual case of measured data captured from the field (sensor values, characteristic values, etc.), it is a prerequisite that a well-defined meaning and optionally a well-defined unit (e.g., temperature in ° C. or pressure in Pa) are allocated to each data point. If meaning and/or unit of a data point are unknown, then an analysis, apart from statistical analyses, is basically impossible. In particular, analysis results cannot be interpreted. Through the use of domain-specific models it is possible to allocate a well-defined meaning with respect to one or more aspects to the measured data. This happens in that, with reference to a domain-specific model, the location of the measured-value capture is defined. Through the analysis of the domain-specific model, the meaning of a data point can then be determined.

Figure 7:
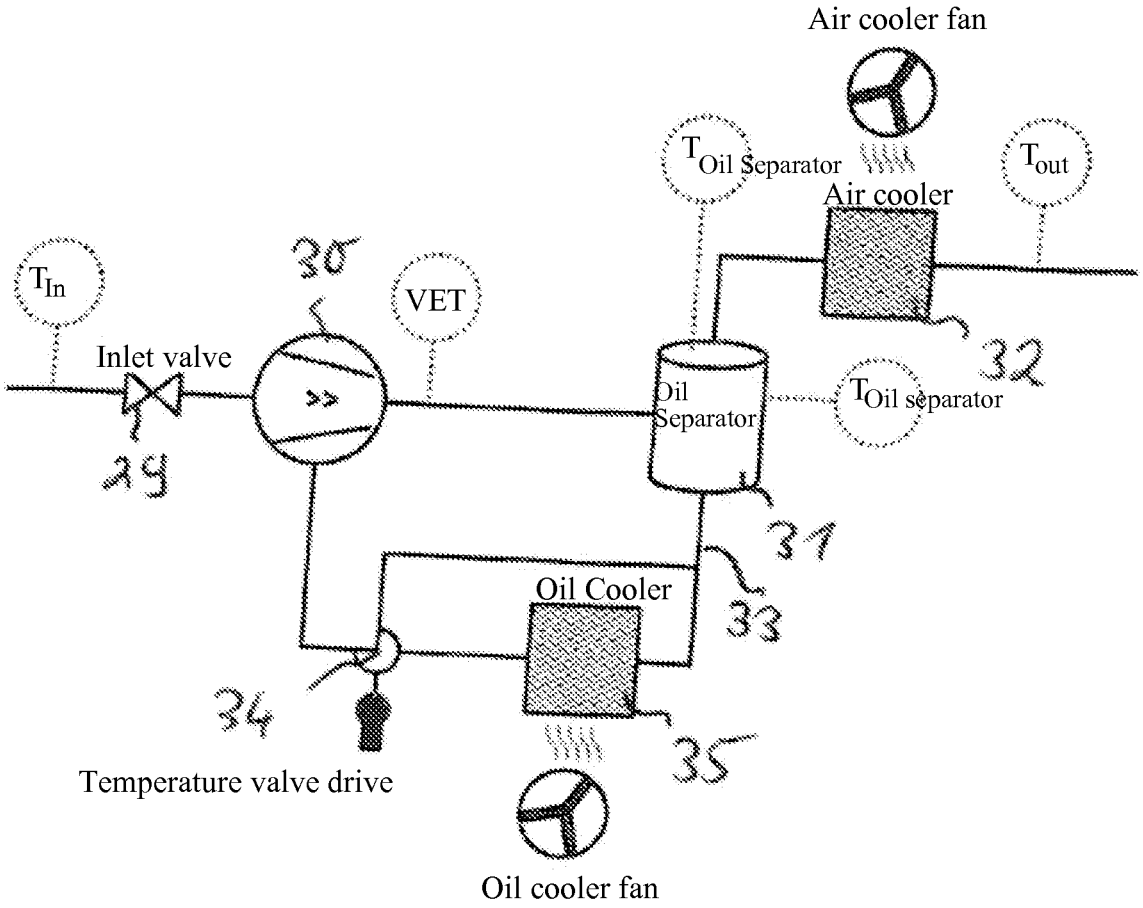
FIG. 7 simplified P&I schematic as a basis model of a stationary, oil-injected screw-type compressor without an add-on dryer.
Figure 8:
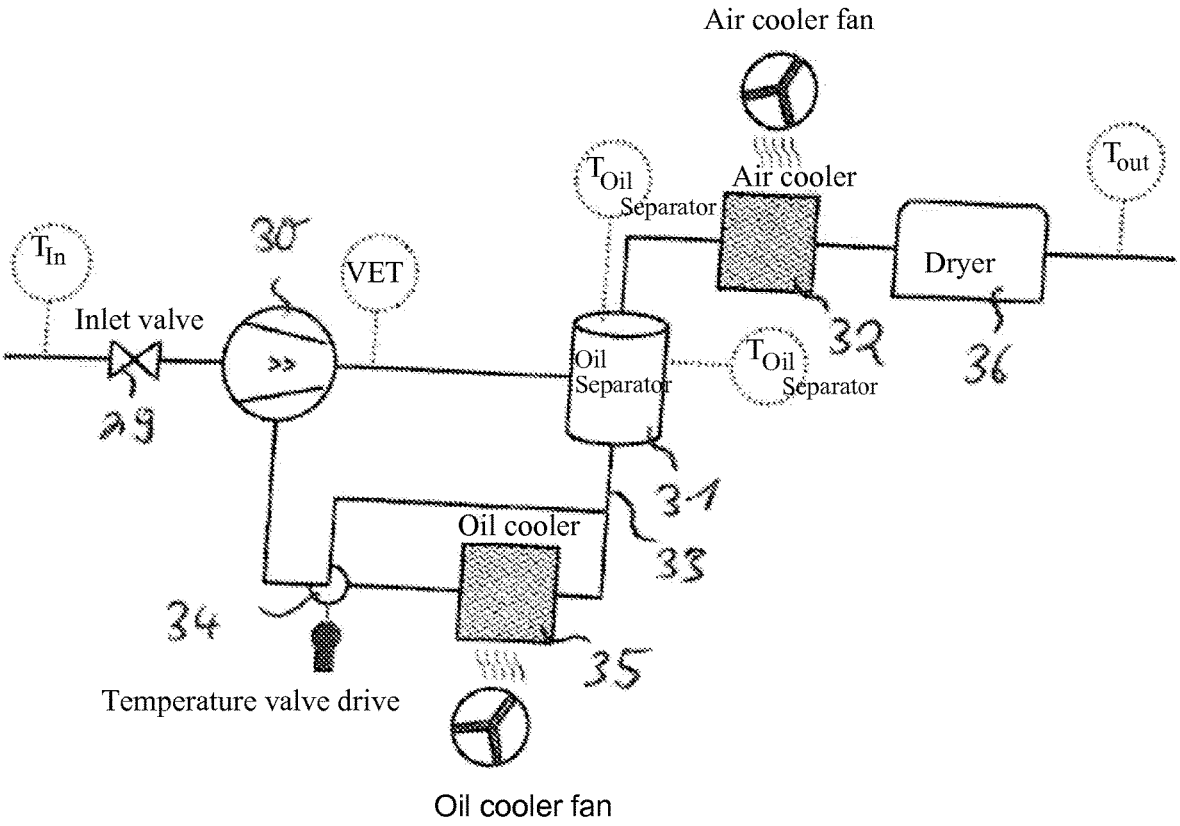
FIG. 8 simplified P&I schematic as a basis model of a stationary, oil-injected screw-type compressor with add-on dryer.

This becomes clear when the P&I schematic of a stationary, oil-injected screw-type compressor without add-on dryer (see FIG. 7) is compared with the P&I schematic of a stationary, oil-injected screw-type compressor with add-on dryer (see FIG. 8). In both compressors, the same number of sensors is installed. The sensors are also named identically. Just from the naming of the sensors, however, no meaning can be derived. This becomes clear with the sensor that supplies the measured value Tout• In the compressor without add-on dryer, the sensor has the meaning "temperature downstream of the air cooler" and "temperature at the output of the compressor." In the compressor with add-on dryer, the sensor has the meaning "temperature downstream of the dryer" and "temperature at the output of the compressor." This difference in meaning is relevant for the analysis. The allocation of the corresponding context information via a defined basis model is decisive, in this respect, to be able to use captured measured values in other control, monitoring, diagnostics, or evaluation routines.

As described above, it is relevant to know the meaning of the measured values at the latest at the time of the analysis. For many applications, however, it is not necessary to know the meaning of a measured value at the time of the measured-value capture. The information on the time value profile of a measured value and the meaning of a measured value can be captured and stored separately from each other. "Separately" can here be understood to mean both chronologically and also spatially (individually and combined). As examples, the following scenarios will be given:

Using a basis model of the compressor system involving a P&I schematic and several basis models of the components of the compressor system involving P&I schematics, the measured value meaning or the context information of the measured values captured by the control/monitoring unit is stored in the control/monitoring unit or externally, for example in a memory section 24. The storage of the context information (measured value meanings) happens, e.g., during the commissioning of the compressor system or during the commissioning of the control/monitoring unit. The context information (measured value meanings) can be stored, e.g., in the form of a table in the control/monitoring unit.

The measured values captured by the control/monitoring unit are stored in the control/monitoring unit typically as a process image (specific values) and as process data history (historical values). The storage can (but does not have to) take place without context information (information on the measured value meaning), because the context information is available at any time in the control/monitoring unit and the measured values can be allocated to a desired time. The allocation of context information to a measured value takes place in one possible embodiment by an allocation table. The allocation table stores what context information is allocated to the measured values. Here, one and the same measured value can simultaneously have multiple (consistent) meanings, and one and the same meaning can obviously be connected to several measured values.

Double assignment of measured value meanings can be useful if the reliability or the accuracy of the measured-value capture is to be increased. For example, if one of two sensors for the measured-value capture fails, the measured value of the other sensor can be used for further processing. If the measured values of both sensors that eventually generate measured values with the same measured value meaning are available, then by calculation (average value, maximum value, minimum value calculation) the accuracy of the measured-value capture can be increased.

Before measured values are processed, if it has not already taken place during storage, measured values and context information (measured value meanings) are joined. By joining the measured values and context information, with the help of the models that were used for defining the context information, an automatic evaluation is possible. For the evaluation, analysis routines are used.

If the analysis routines run in the control and monitoring unit or if the system that executes the analysis routines is connected in terms of data to the control and monitoring unit, then automatic evaluation is also possible in real time.

With regard to the development of basis models for compressor systems, refer to EP 13159618.1 that is herewith referenced in full. At the same time, the data standardized according to the present disclosure could also contribute to refining the definition of interactions between components of a compressor system defined in EP 13159618.1 in the form of a P&I schematic.

The data standardized according to the present disclosure can also be used in models derived during development, such as those in EP 13159616.5, which is hereby referenced in its full extent.

Although the disclosure has been described using a compressor system, even for over pressure, all of the principles can be transferred to a vacuum system that acts with pumps instead of compressors.

We claim:

1. A method for controlling or monitoring a compressor system, the method comprising:

capturing measured values within the compressor system, each measured value being associated with a respective timestamp, the compressor system comprising a plurality of components and the measured values generated during operation of the compressor system;

automatically allocating context information to the measured values to create standardized measured values, each standardized measured value associating contextual information regarding a meaning of a given measured value within a specific configuration of the plurality of components within a given compressor system to the given measured value and a sub-meaning for the meaning, the sub-meaning incorporating into the meaning relationships between the meaning of the given measured value and components within the specific configuration of the plurality of components, the meaning and the sub-meaning being automatically captured from one or more models of the compressor system, the allocation of context information being performed using the respective timestamps of the measured values; and utilizing at least one of the standardized measured values or utilizing at least one of the measured values and at least one of the standardized measured values in control and monitoring routines for processing the measured values that are running on a control unit of the compressor system to perform tasks in the compressor system without making compressor system-specific adaptations to the control and monitoring routines for processing the measured values.

2. The method of claim 1, wherein allocating further comprises allocating to each standardized measured value a real location within the compressor system where the measured value associated with each standardized measured value is captured.

3. The method of claim 2, wherein allocating to each standardized measured value a real location comprises allocating two or more real locations to one or more standardized measured values.

4. The method of claim 2, wherein each real location is defined directly using a model of the plurality of components of the compressor system.

5. The method of claim 2, wherein the method further comprises defining the real location of each measured value by allocating to each measured value a pre-configured measurement location on a component within the plurality of components wherein linking among components within the plurality of components is not taken into account.

6. The method of claim 2, wherein the method further comprises defining the real location of each measured value by freely configuring a measurement location on a component within the plurality of components to each measured value wherein linking among components within the plurality of components is not taken into account.

7. The method of claim 2, wherein the method further comprises defining the real location of each measured value by allocating to each measured value a pre-configured measurement location on a component within the plurality of components from a basis model of a connection among the plurality of components of the compressor system.

8. The method of claim 2, wherein the method further comprises defining the real location of each measured value by freely configuring a measurement location on a component within the plurality of components to each measured value from a basis model of a connection among the plurality of components of the compressor system.

9. The method of claim 1, wherein the plurality of components comprises compressors and peripheral devices, the peripheral devices comprising filters, dryers, storage devices, air coolers, oil separators, valves, piping and sensors.

10. The method of claim 1, wherein the context information comprises a type of measurement, measurement units, or type of measurement and measurement units.

11. The method of claim 1, wherein the tasks comprise control tasks, monitoring tasks, diagnostics tasks or evaluation tasks.

12. A compressor system comprising:

a plurality of components;

sensors disposed within the compressor system or the plurality of components to capture measured values generated by the compressor system or the plurality of components;

a memory comprising a database containing the measured values and context information;

a control/monitoring unit connected to and in communication with the memory, one or more sensors of the plurality of sensors, and one or more components of the plurality of components;

a measured-value capture unit in communication with the plurality of sensors and the control/monitoring unit to record the measured values captured through measurement during operation of the compressor system, each measured value being associated with a respective timestamp;

an allocation unit in communication with the database and the control/monitoring unit to automatically join context information to measured values to create standardized measured values, each standardized measured value associating contextual information regarding a meaning of a given measured value within a specific configuration of the plurality of components within a given compressor system to the given measured value and a sub-meaning for the meaning, the sub-meaning incorporating into the meaning relationships between the meaning of the given measured value and components within the specific configuration of the plurality of components, the meaning and the sub-meaning being automatically captured from one or more models of the compressor system, the joining of context information to measured values being performed using the respective timestamps of the measured values; and an interface in communication with the database and one or more components of the plurality of components to utilize at least one of the standardized measured values or to utilize at least one of the measured values and at least one of the standardized measured values in control and monitoring routines for processing the measured values that are running on a control unit of the compressor system to perform tasks in the compressor system without making compressor system-specific adaptations to the control and monitoring routines for processing the measured values.

13. The compressor system of claim 12, wherein the plurality of components comprises compressors and peripheral devices, and the peripheral devices comprise filters, dryers, storage devices, air coolers, oil separators, valves, and piping.

14. The compressor system of claim 12, the context information comprises a type of measurement, measurement units, or a type of measurement and measurement units.

15. The compressor system of claim 12, wherein the tasks comprise control tasks, monitoring tasks, diagnostics tasks or evaluation tasks.

16. The compressor system of claim 12, wherein the control/monitoring unit defines the real location of each measured value without taking into account linking among components within the plurality of components by allocating to each measured value a pre-configured measurement location on a component within the plurality of components or freely configuring a measurement location on a component within the plurality of components to each measured value.

17. The compressor system of claim 12, wherein the control/monitoring unit defines the real location of each measured value by allocating to each measured value a pre-configured measurement location on a component within the plurality of components from a basis model of a connection among the plurality of components of the compressor system or freely configuring a measurement location on a component within the plurality of components to each measured value from a basis model of a connection among the plurality of components of the compressor system.

18. A method for controlling or monitoring a modular compressor system, the method comprising:

capturing measured values within the compressor system, the compressor system comprising a plurality of components and the measured values generated during operation of the compressor system, at least one of the components being an exchangeable component;

automatically allocating context information to the measured values to create standardized measured values, each standardized measured value associating contextual information regarding a meaning of a given measured value within a specific configuration of the plurality of components within a given compressor system to the given measured value and a sub-meaning for the meaning, the sub-meaning incorporating into the meaning relationships between the meaning of the given measured value and components within the specific configuration of the plurality of components, the context information comprising a location within the compressor system where the given measured value is captured and a relationship of the location to one or more components of the plurality of components; and utilizing at least one of the measured values, at least one of the standardized measured values, or at least one of the measured values and at least one of the standardized measured values in control and monitoring routines for processing the measured values that are running on a control unit of the compressor system to perform tasks in the compressor system, wherein the control unit is coupled with at least one exchangeable component, and wherein the exchangeable component is exchangeable in terms of controlling and monitoring by modification of the exchangeable component's allocated context information without making compressor system-specific adaptations to the control and monitoring routines.

* * * * *